US008053694B2

(12) United States Patent
Spitsberg et al.

(10) Patent No.: US 8,053,694 B2
(45) Date of Patent: Nov. 8, 2011

(54) MECHANISM OR RESETTABLE TRIP INDICATOR MECHANISM FOR A CIRCUIT INTERRUPTER AND CIRCUIT INTERRUPTER INCLUDING THE SAME

(75) Inventors: Yuri C. Spitsberg, Export, PA (US); Thomas A. Whitaker, North Huntingdon, PA (US)

(73) Assignee: Eaton Corporation, Cleveland, OH (US)

( * ) Notice: Subject to any disclaimer, the term of this patent is extended or adjusted under 35 U.S.C. 154(b) by 374 days.

(21) Appl. No.: 12/424,055

(22) Filed: Apr. 15, 2009

(65) Prior Publication Data

US 2010/0264001 A1 Oct. 21, 2010

(51) Int. Cl.
*H01H 9/00* (2006.01)

(52) U.S. Cl. ..... 200/308; 200/401

(58) Field of Classification Search ..... 200/308, 200/401

See application file for complete search history.

(56) References Cited

U.S. PATENT DOCUMENTS 4,743,878 A * 5/1988 Ohishi et al. ..... 335/172
5,089,796 A * 2/1992 Glennon et al. ..... 335/172
5,144,516 A * 9/1992 Sham ..... 361/49
6,104,265 A * 8/2000 Maloney et al. ..... 335/13
6,222,433 B1 * 4/2001 Ramakrishnan et al. ..... 335/17
6,225,883 B1 * 5/2001 Wellner et al. ..... 335/172
6,803,535 B1 * 10/2004 Whipple et al. ..... 200/308
2003/0016101 A1 * 1/2003 Germain et al. ..... 335/6
2003/0234710 A1 * 12/2003 Yamagata et al. ..... 335/174
2008/0245649 A1 10/2008 Spitsberg et al.
2008/0246565 A1 10/2008 Spitsberg et al.

* cited by examiner

*Primary Examiner* — Elvin G Enad
*Assistant Examiner* — Lisa Klaus
(74) *Attorney, Agent, or Firm* — Martin J. Moran

(57) ABSTRACT

A circuit interrupter mechanism includes a first member movable in a first longitudinal direction and an opposite second longitudinal direction, and a second member pivotal in a first pivotal direction and an opposite second pivotal direction. A first tab is fixedly coupled to one of the first and second members, and a second tab is pivotally coupled to the other of the members. The first tab engages and disengages from the second tab during movement of the first member in the first longitudinal direction and in the second longitudinal direction. The second tab pivots with respect to the other of the members when engaged by the first tab during movement of the first member in the first longitudinal direction. The second tab does not pivot with respect to the other of the members when engaged by the first tab during movement of the first member in the second longitudinal direction.

17 Claims, 7 Drawing Sheets

MECHANISM OR RESETTABLE TRIP INDICATOR MECHANISM FOR A CIRCUIT INTERRUPTER AND CIRCUIT INTERRUPTER INCLUDING THE SAME

BACKGROUND

1. Field

The disclosed concept pertains generally to electrical switching apparatus and, more particularly, to mechanisms for circuit interrupters. The disclosed concept also pertains to resettable trip indicator mechanisms for circuit interrupters. The disclosed concept further pertains to circuit interrupters.

2. Background Information

Circuit interrupters, such as for example and without limitation, circuit breakers, are used to protect electrical circuitry from damage due to an overcurrent condition, such as an overload condition, a short circuit or another fault condition, such as an arc fault or a ground fault. Molded case circuit breakers typically include at least one pair of separable contacts per phase. The separable contacts may be operated either manually by way of a handle disposed on the outside of the case or automatically in response to a detected fault condition. Typically, such circuit breakers include an operating mechanism, which is designed to rapidly open and close the separable contacts, and a trip mechanism, such as a trip unit, which senses a number of fault conditions to trip the breaker automatically. Upon sensing a fault condition, the trip unit trips the operating mechanism to a trip state, which moves the separable contacts to their open position.

It is known to hold a trip shaft in a rotated position when a circuit breaker is tripped. For example, some power circuit breakers employ a Resettable Trip Indicator (RTI) to signal a user that the circuit breaker has tripped due to an overload condition. In many instances, the circuit breaker is inoperable until the RTI is reset. For example, the RTI is often used in the IEC (European) market, while the UL/ANSI (United States) market often employs a Trip Indicator (TI).

Both of the RTI and TI provide an indication that a circuit breaker tripped as a result of an overload (e.g., short circuit) in an electrical system. For example, an RTI or TI push button/indicator can be a suitable color (e.g., red), such that when it pops-up it becomes clearly visible since it protrudes above the circuit breaker front cover.

It is a good practice to reset the TI push button/indicator by pressing the push button down from the popped-up position after removing the overload (e.g., short circuit) condition. However, the TI does not require being reset since the circuit breaker remains fully functional regardless of the TI position (e.g., reset or popped-up). Conversely, the RTI is required to be reset (e.g. by pushing the RTI push button down from the popped-up position), in order to enable the circuit breaker to close, since the RTI push button holds a trip shaft in a rotated position after the circuit breaker is tripped. This prevents the circuit breaker from closing until the trip shaft returns to its initial, non-rotated position.

In some known circuit breakers, a trip actuator is employed to unlatch an operating mechanism and trip open separable contacts in response to an overcurrent condition. For example, the trip actuator trips the circuit breaker by extending a plunger, which, in turn rotates a trip shaft. As soon as the trip actuator plunger is extended, the circuit breaker cannot be closed. For example, some of these known circuit breakers reset the trip state and return the trip actuator plunger to a retracted position by pushing a trip indicator rod. Others of these known circuit breakers are reset by other mechanisms (e.g., by an "opening yoke"). The "opening yoke" resets the trip actuator every time when the circuit breaker trips. In other words, the trip actuator trips the circuit breaker (e.g., by extending the trip actuator plunger). The "opening yoke" (during the tripping operation) resets the trip actuator (e.g., by pushing the trip actuator plunger back in its retracted position). In this case, the trip shaft is held in a rotated tripped position by a special linkage and not by the trip actuator plunger.

There is room for improvement in mechanisms for circuit interrupters.

There is also room for improvement in resettable trip indicator mechanisms for circuit interrupters.

There is further room for improvement in circuit interrupters including resettable trip indicator mechanisms.

SUMMARY

These needs and others are met by embodiments of the disclosed concept, which provide a first tab structured to engage and disengage from a second tab during movement of a first member in a first longitudinal direction, the first tab is structured to engage and disengage from the second tab during movement of the first member in an opposite second longitudinal direction, the second tab is structured to pivot with respect to one of the first member and a second member when engaged by the first tab during movement of the first member in the first longitudinal direction, and the second tab is structured to not pivot with respect to the one of the first member and the second member when engaged by the first tab during movement of the first member in the opposite second longitudinal direction.

In accordance with one aspect of the disclosed concept, a mechanism for a circuit interrupter comprises: a first member movable in a first longitudinal direction and a second longitudinal direction, which is opposite the first longitudinal direction; a second member pivotal in a first pivotal direction and a second pivotal direction, which is opposite the first pivotal direction; a first tab fixedly coupled to one of the first member and the second member; and a second tab pivotally coupled to the other of the first member and the second member, wherein the first tab is structured to engage and disengage from the second tab during movement of the first member in the first longitudinal direction, wherein the first tab is structured to engage and disengage from the second tab during movement of the first member in the second longitudinal direction, wherein the second tab is structured to pivot with respect to the other of the first member and the second member when engaged by the first tab during movement of the first member in the first longitudinal direction, and wherein the second tab is structured to not pivot with respect to the other of the first member and the second member when engaged by the first tab during movement of the first member in the second longitudinal direction.

The first tab may be fixedly coupled to the first member; the second tab may be pivotally coupled to the second member; the second tab may be structured to pivot with respect to the second member when engaged by the first tab during movement of the first member in the first longitudinal direction, and the second tab may be structured to not pivot with respect to the second member when engaged by the first tab during movement of the first member in the second longitudinal direction.

The first tab may be fixedly coupled to the second member; the second tab may be pivotally coupled to the first member; the second tab may be structured to pivot with respect to the first member when engaged by the first tab during movement of the first member in the first longitudinal direction, and the second tab may be structured to not pivot with respect to the first member when engaged by the first tab during movement of the first member in the second longitudinal direction.

As another aspect of the disclosed concept, a resettable trip indicator mechanism is for a circuit interrupter including a pivotal trip shaft pivotal between a first pivotal position in which the circuit interrupter is tripped and inoperable and a different second pivotal position in which the circuit interrupter is operable. The resettable trip indicator mechanism comprises: a trip indicator member movable in a first longitudinal direction and a second longitudinal direction, which is opposite the first longitudinal direction; a pivotal link member; a first tab fixedly coupled to one of the trip indicator member and the pivotal link member; a second tab pivotally coupled to the other of the trip indicator member and the pivotal link member; an operating linkage cooperating with the pivotal link member, the operating linkage being structured to capture the pivotal trip shaft in the first pivotal position before movement of the trip indicator member in the first longitudinal direction; and a pivotal trip indicator member release structured to capture the trip indicator member when the pivotal trip shaft is in the different second pivotal position in which the circuit interrupter is operable, and to release the trip indicator member when the pivotal trip shaft is in the first pivotal position in which the circuit interrupter is tripped and inoperable, wherein the first tab is structured to engage and disengage from the second tab during movement of the trip indicator member in the first longitudinal direction, wherein the first tab is structured to engage and disengage from the second tab during movement of the trip indicator member in the second longitudinal direction, wherein the second tab is structured to pivot with respect to the other of the trip indicator member and the pivotal link member when engaged by the first tab during movement of the trip indicator member in the first longitudinal direction, wherein the second tab is structured to not pivot with respect to the other of the trip indicator member and the pivotal link member when engaged by the first tab during movement of the trip indicator member in the second longitudinal direction, wherein one of the first tab and the second tab is structured to pivot the pivotal link member when the first tab engages the second tab during movement of the trip indicator member in the second longitudinal direction, and wherein the operating linkage is further structured to release the pivotal trip shaft from the first pivotal position responsive to the one of the first tab and the second tab pivoting the pivotal link member.

A pivotal first link assembly may include the pivotal link member and the second tab, which may be pivotally coupled to the pivotal link member; the operating linkage comprises a pivotal second link having a hook; and the hook may be structured to capture the pivotal trip shaft in the first pivotal position before movement of the trip indicator member in the first longitudinal direction.

The pivotal link member may maintain the same position immediately before the second tab may be engaged by the first tab, when the second tab may be engaged by the first tab, and immediately after the second tab may be disengaged from the first tab during movement of the trip indicator member in the first longitudinal direction.

As another aspect of the disclosed concept, a circuit interrupter comprises: separable contacts; an operating mechanism structured to open and close the separable contacts; a trip mechanism cooperating with the operating mechanism to trip open the separable contacts, the trip mechanism comprising a pivotal trip shaft pivotal between a first pivotal position in which the circuit interrupter is tripped and inoperable and a different second pivotal position in which the circuit interrupter is operable; and a resettable trip indicator mechanism comprising: a trip indicator member movable in a first longitudinal direction and a second longitudinal direction, which is opposite the first longitudinal direction, a pivotal link member, a first tab fixedly coupled to one of the trip indicator member and the pivotal link member, a second tab pivotally coupled to the other of the trip indicator member and the pivotal link member, an operating linkage cooperating with the pivotal link member, the operating linkage being structured to capture the pivotal trip shaft in the first pivotal position before movement of the trip indicator member in the first longitudinal direction, and a pivotal trip indicator member release structured to capture the trip indicator member when the pivotal trip shaft is in the different second pivotal position in which the circuit interrupter is operable, and to release the trip indicator member when the pivotal trip shaft is in the first pivotal position in which the circuit interrupter is tripped and inoperable, wherein the first tab is structured to engage and disengage from the second tab during movement of the trip indicator member in the first longitudinal direction, wherein the first tab is structured to engage and disengage from the second tab during movement of the trip indicator member in the second longitudinal direction, wherein the second tab is structured to pivot with respect to the other of the trip indicator member and the pivotal link member when engaged by the first tab during movement of the trip indicator member in the first longitudinal direction, wherein the second tab is structured to not pivot with respect to the other of the trip indicator member and the pivotal link member when engaged by the first tab during movement of the trip indicator member in the second longitudinal direction, wherein one of the first tab and the second tab is structured to pivot the pivotal link member when the first tab engages the second tab during movement of the trip indicator member in the second longitudinal direction, and wherein the operating linkage is further structured to release the pivotal trip shaft from the first pivotal position responsive to the one of the first tab and the second tab pivoting the pivotal link member.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "tab" shall mean a fixed and/or pivotable projecting device or member.

The disclosed concept is described in association with a resettable trip indicator mechanism for a circuit interrupter, although the disclosed concept is applicable to a wide range of mechanisms for a wide range of circuit interrupters.

Figure 1:
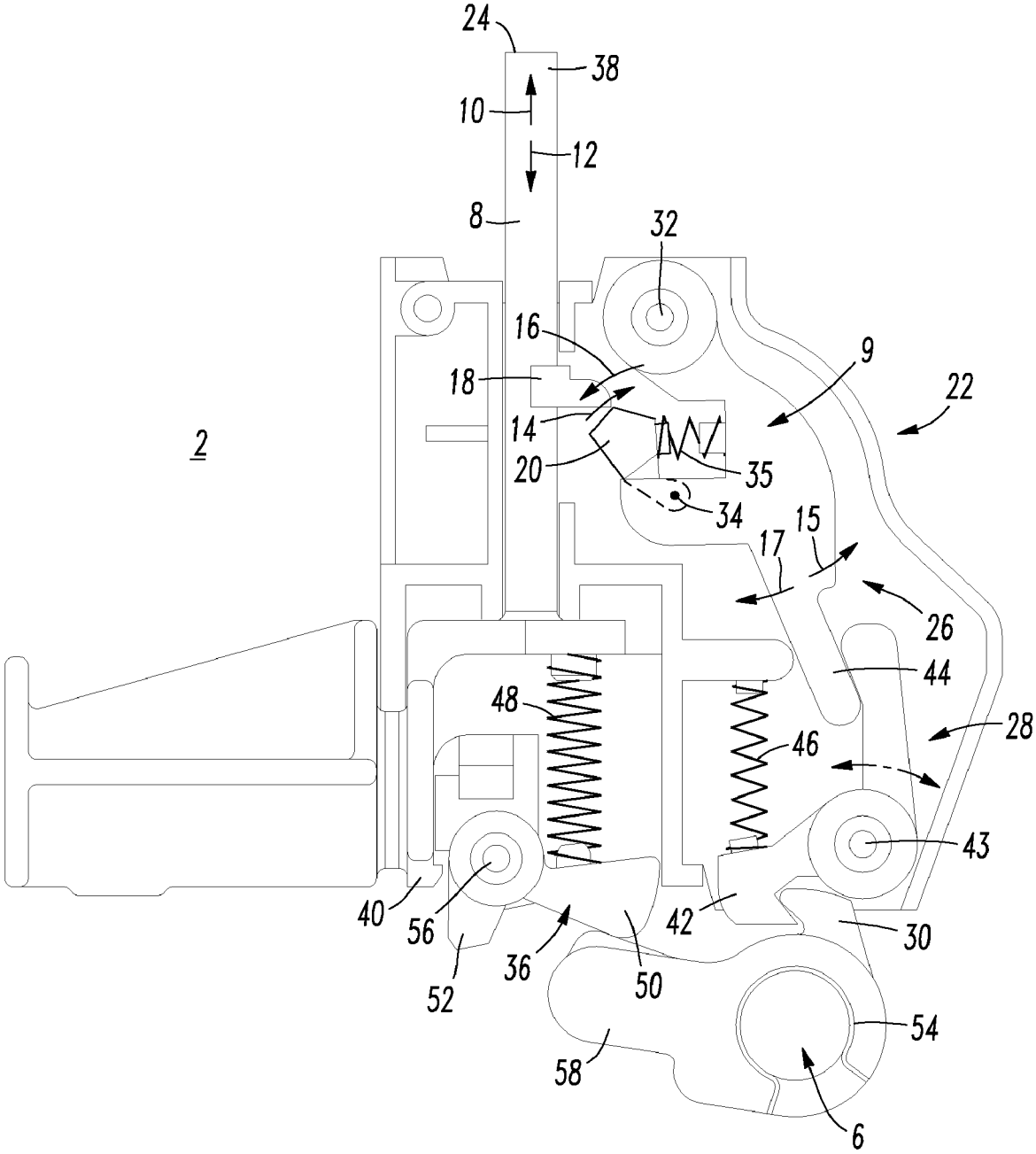
FIG. 1 is a vertical elevation view of a trip indicator operating linkage catching a trip D-shaft in a tripped/rotated position, thereby making a corresponding circuit breaker inoperable in accordance with embodiments of the invention.
Figure 2:
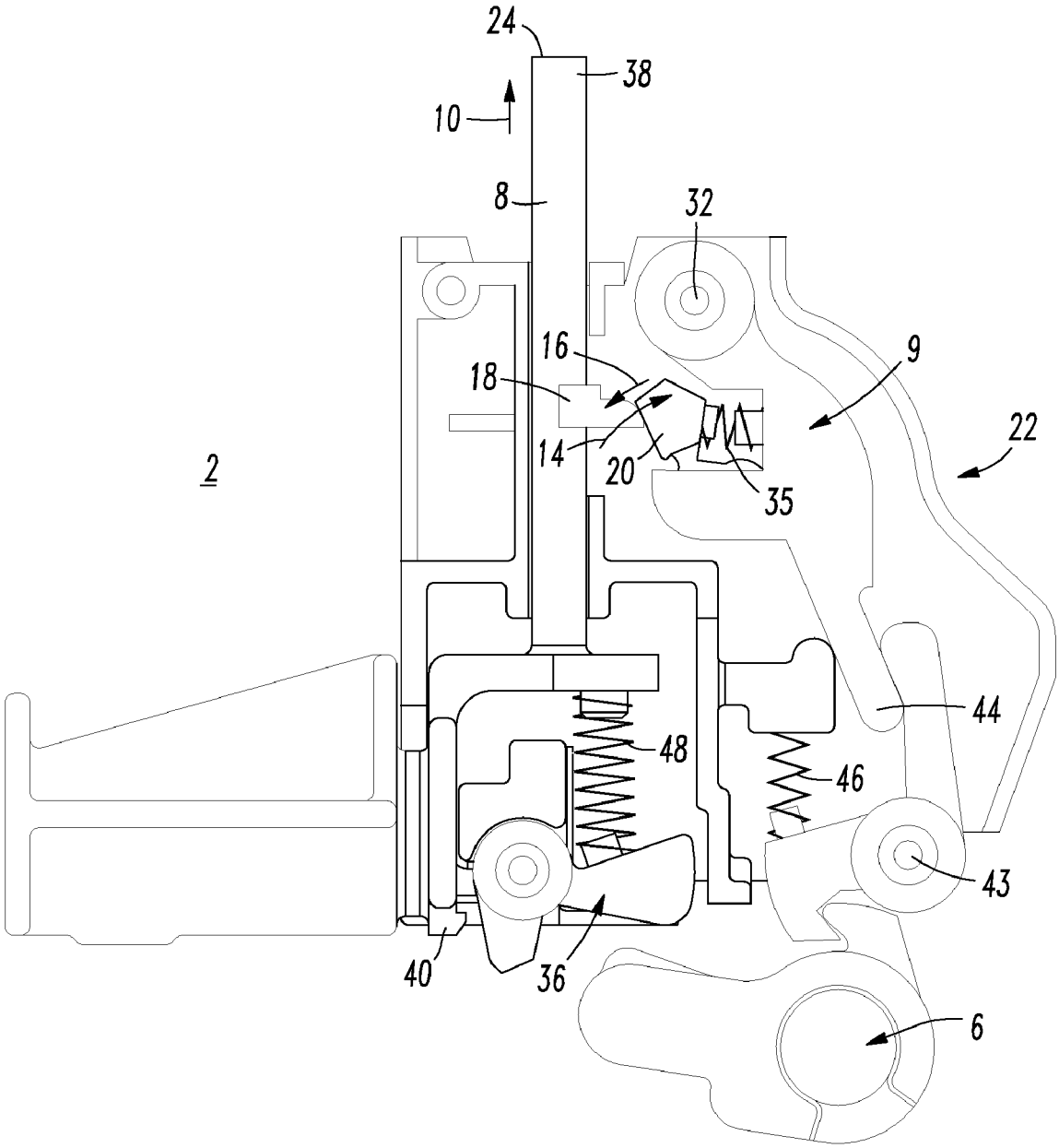
FIG. 2 is a vertical elevation view similar to FIG. 1, except that after the trip D-shaft is held by the trip indicator operating linkage in the tripped/rotated position, a trip indicator push button moves up toward its extended position without disturbing the tripped/rotated position of the trip D-shaft.
Figure 3:
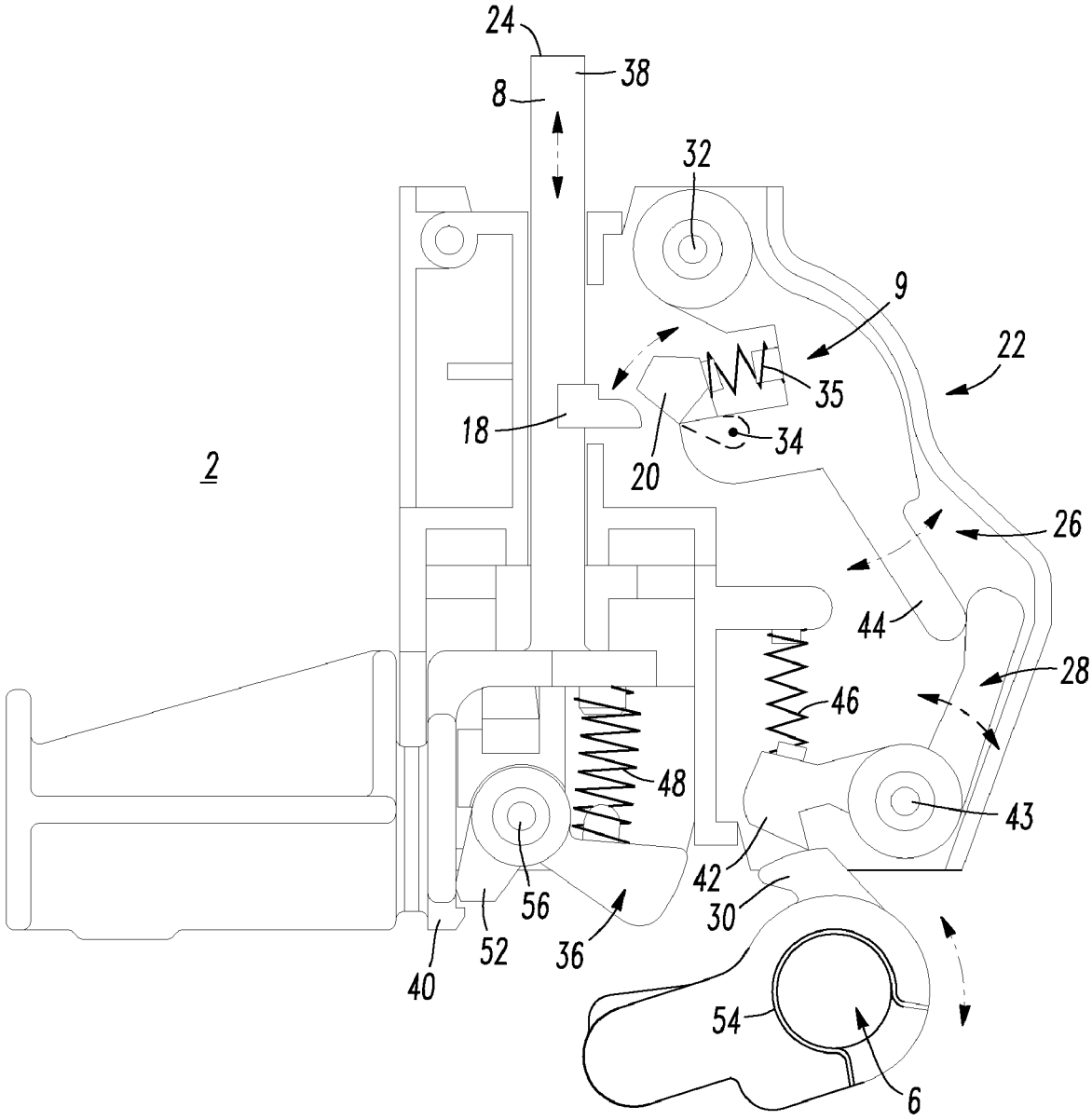
FIG. 3 is a vertical elevation view similar to FIG. 1, except that when the trip indicator push button is pushed down to its retracted position, the trip indicator operating linkage releases the trip D-shaft, thereby making the corresponding circuit breaker operable again.
Figure 6A:
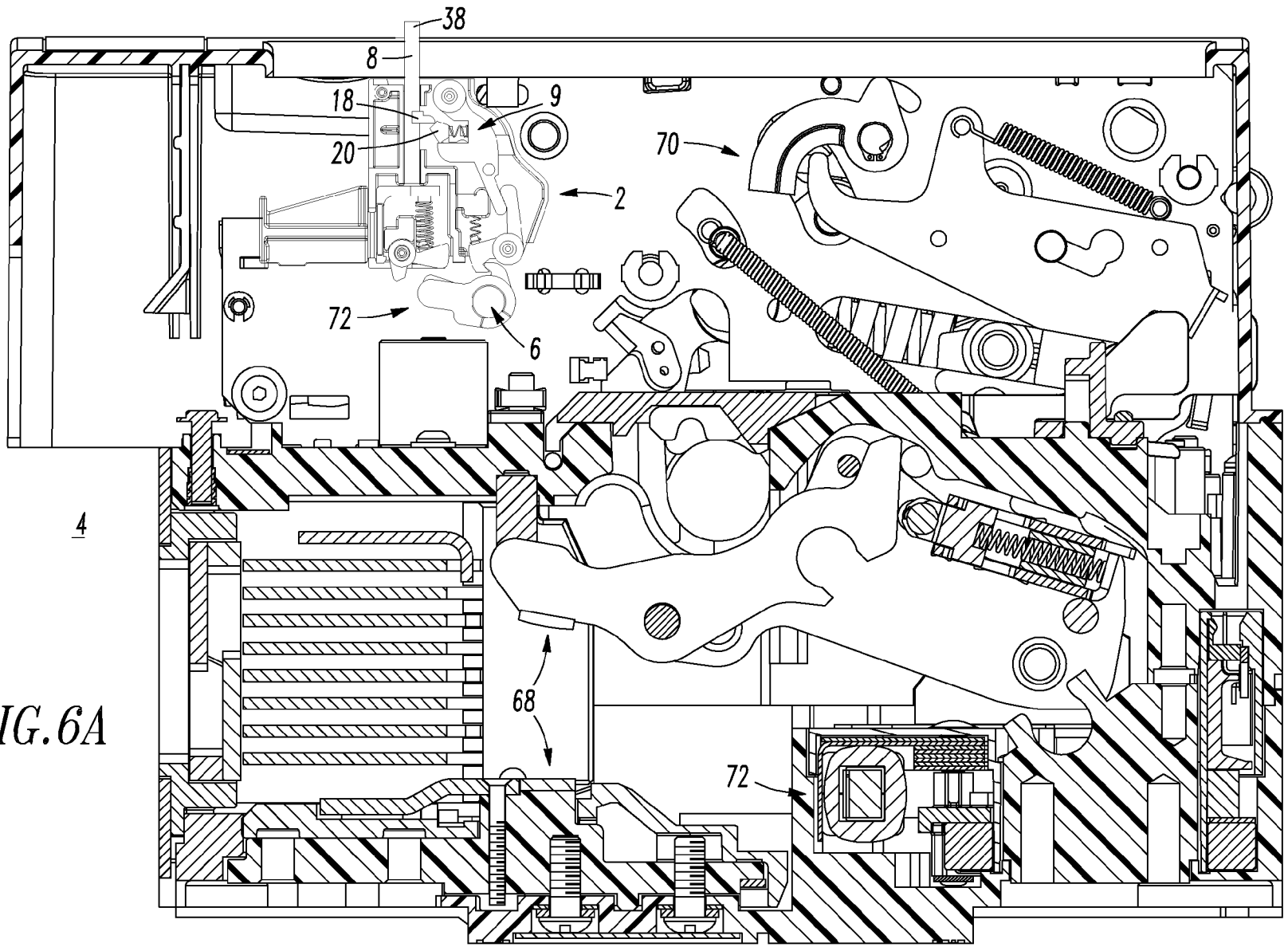
FIGS. 6A-6B are vertical cross-sectional views of a circuit breaker including the resettable trip indicator and the trip D-shaft of FIG. 1 along with an operating mechanism, trip mechanism and separable contacts as shown in the tripped and reset positions, respectively.
Figure 6B:
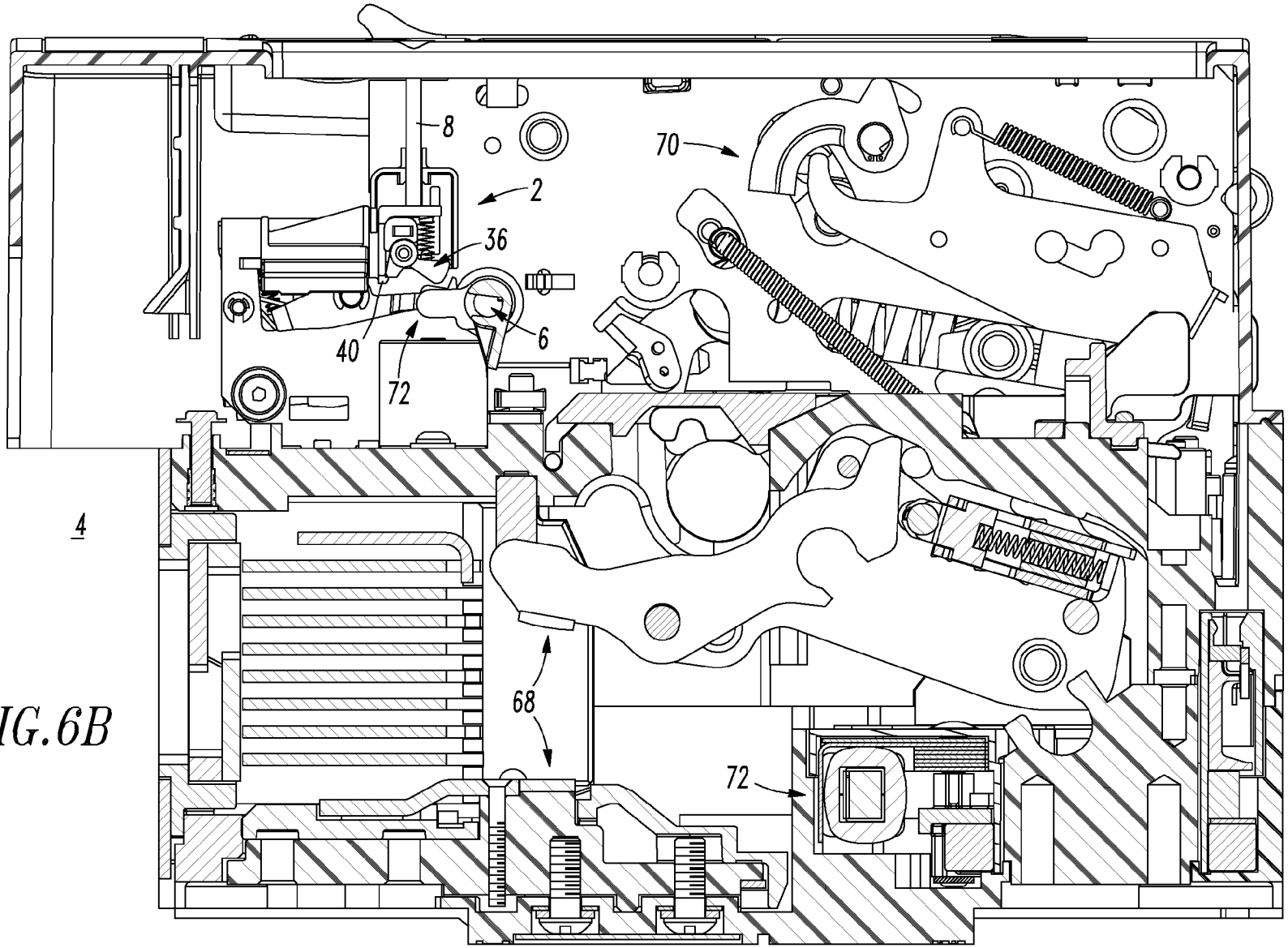

Referring to FIGS. 1-3, a mechanism, such as a resettable trip indicator mechanism 2, is for a circuit interrupter 4 (FIGS. 6A and 6B). The circuit interrupter 4 includes a pivotal trip shaft 6 pivotal between a first pivotal position (FIG. 1) in which the circuit interrupter 4 is tripped and inoperable and a different second pivotal position (FIG. 3) in which the circuit interrupter 4 is operable.

The example resettable trip indicator mechanism 2 includes a first member, such as a trip indicator member 8, movable in a first longitudinal direction 10 (e.g., without limitation, upward with respect to FIG. 1) and a second longitudinal direction 12 (e.g., without limitation, downward with respect to FIG. 1), which is opposite the first longitudinal direction 10. A second member, such as a pivotal link member 9, is pivotal in a first pivotal direction 15 (e.g., without limitation, counterclockwise with respect to FIG. 1) and a second pivotal direction 17 (e.g., without limitation, clockwise with respect to FIG. 1), which is opposite the first pivotal direction 15.

Figure 5:
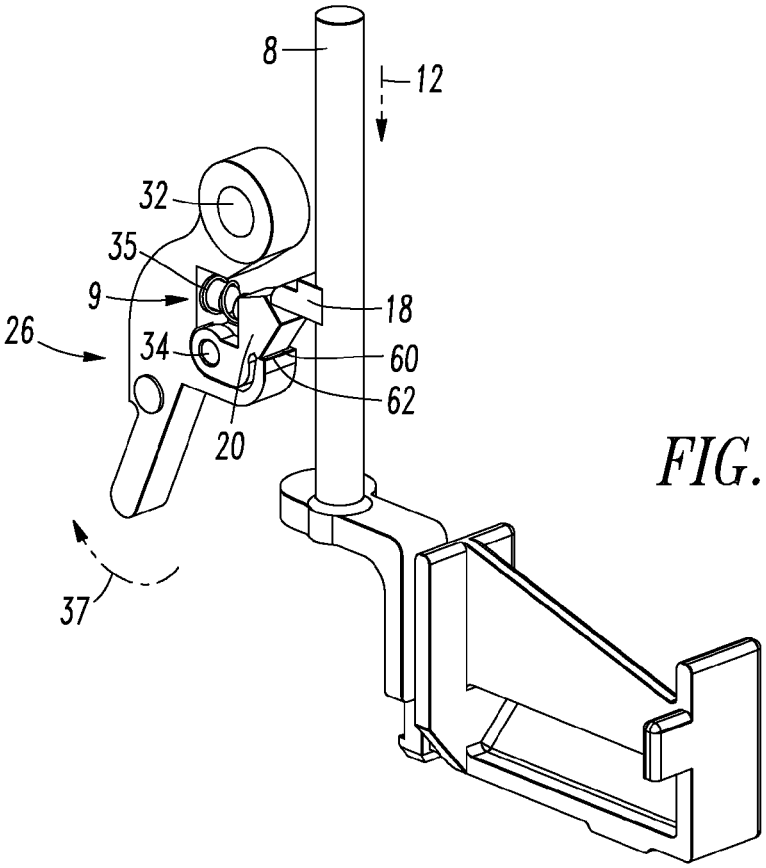
FIG. 5 is an isometric view of an upper link tab, an upper link and a push button tab of FIG. 1 during a reset operation.

A first tab 18 is fixedly coupled to one of the trip indicator member 8 and the pivotal link member 9. In the example of FIGS. 1-3, the first tab 18 is fixedly coupled to the trip indicator member 8. A second tab 20 is pivotally coupled to the other of the trip indicator member 8 and the pivotal link member 9. In the example of FIGS. 1-3, the second tab 20 is pivotally coupled to the pivotal link member 9. As will be described, the first tab 18 is structured to engage and disengage from the second tab 20 during movement of the trip indicator member 8 in the first longitudinal direction 10 (see, for example, FIG. 2 followed by FIG. 1), and is also structured to engage and disengage from the second tab 20 during movement of the trip indicator member 8 in the second longitudinal direction 12 (see, for example, FIG. 5 followed by FIG. 3). As is best shown in FIG. 2, the second tab 20 is structured to pivot with respect to the other of the trip indicator member 8 and the pivotal link member 9 (e.g., in FIGS. 1-3, the first tab 18 is fixedly coupled to the trip indicator member 8, and the second tab 20 is structured to pivot with respect to the pivotal link member 9) when engaged by the first tab 18 during movement of the trip indicator member 8 in the first longitudinal direction 10. Also, as is best shown in FIGS. 1 and 5), the second tab 20 is structured to not pivot with respect to the other of the trip indicator member 8 and the pivotal link member 9 (e.g., in FIG. 5, the second tab 20 is structured to not pivot with respect to the pivotal link member 9) when engaged by the first tab 18 during movement of the trip indicator member 8 in the second longitudinal direction 12.

Continuing to refer to the example of FIGS. 1-3, a trip indicator operating linkage or reset linkage chain 22 includes a push button portion 24, a pivotal first link assembly 26, a pivotal second link 28 and a trip D-shaft hook 30, which is disposed on the pivotal trip shaft 6 (e.g., a pivotal trip D-shaft). The first link assembly 26 includes the pivotal link member 9, having pivot 32, and the second tab 20, which has its own pivot 34 (best shown in FIG. 5). The operating linkage or reset linkage chain 22 cooperates with the pivotal link member 9 and is structured to capture the pivotal trip shaft 6 in the first pivotal position (as shown in FIGS. 1 and 2) before movement of the trip indicator member 8 in the first longitudinal direction 10 (as is best shown with reference to FIG. 2 followed by FIG. 1). In this example, a pivotal trip indicator member release 36 is structured to capture (as best shown in FIGS. 3 and 6B) the trip indicator member 8 when the pivotal trip shaft 6 is in the different second pivotal position (FIGS. 3 and 6B) in which the circuit interrupter 4 (FIG. 6B) is operable, and to release the trip indicator member 8 when the pivotal trip shaft 6 is the first pivotal position (FIG. 1) in which the circuit interrupter 4 is tripped and inoperable (FIG. 6A).

The pivotal link member 9 freely pivots about the pivot 32. The second tab 20 freely pivots about the pivot 34 against the bias of spring 35 in the first pivotal direction 14 from a normal position (FIGS. 1 and 5) where the second tab 20 can be engaged (e.g., see FIG. 2) by the first tab 18 during movement of the trip indicator member 8 in the first longitudinal direction 10. The second tab 20 compresses the spring 35 when it freely pivots about the second pivot 34 in the first pivotal direction 14. After the second tab 20 is disengaged from the first tab 18 during movement of the trip indicator member 8 in the first longitudinal direction 10, the spring 35 pivots the second tab 20 back to the normal position. The second tab 20 does not pivot about the pivot 34 in the opposite second pivotal direction 16 when the second tab 20 is engaged by the first tab 18 during movement (FIGS. 1 and 5) of the trip indicator member 8 in the second longitudinal direction 12.

In the example of FIGS. 1-3, one of the first tab 18 and the second tab 20 (e.g., second tab 20 of FIG. 5) is structured to pivot (e.g., clockwise 37 with respect to FIG. 5) the pivotal link member 9 when the first tab 18 engages the second tab 20 during movement of the trip indicator member 8 in the second longitudinal direction 12. The operating linkage 22 is structured to release (as best shown in FIG. 3) the pivotal trip shaft 6 from the first pivotal position (FIG. 1) responsive to the one of the first tab 18 and the second tab 20 (e.g., second tab 20 of FIG. 5) pivoting the pivotal link member 9 (as best shown in FIG. 3). As is shown in FIGS. 1-3, the first tab 18 is fixedly coupled to the trip indicator member 8 and the second tab 20 is pivotally coupled to the pivotal link member 9. The second tab 20 is structured to pivot with respect to the pivotal link member 9 when engaged by the first tab 18 during movement of the trip indicator member 8 in the first longitudinal direction 10, and the second tab 20 is structured to not pivot with respect to the pivotal link member 9 when engaged by the first tab 18 during movement of trip indicator member 8 in the second longitudinal direction 12.

The example resettable trip indicator member 8 includes an elongated portion having a first end 38 structured to indicate a trip condition of the circuit interrupter 4 (FIG. 6A) and an opposite second end 40 structured to be captured (as best shown in FIG. 3) during a non-trip condition of the circuit interrupter 4. As shown in the example of FIGS. 1-3, the example first tab 18 is fixedly coupled to the elongated portion of the trip indicator member 8.

The example pivotal first link assembly 26 includes the pivotal link member 9 and the second tab 20, which is pivotally coupled to the pivotal link member 9. The operating linkage 22 includes the pivotal second link 28 having a hook 42 and a pivot 43. The hook 42 captures the hook 30 of the pivotal trip shaft 6 in the first pivotal position (FIG. 1) before movement of the trip indicator member 8 in the first longitudinal direction 10. The pivotal first link assembly 26 also includes a finger 44, which engages and pivots the pivotal second link 28 (as shown by FIG. 1 followed by FIG. 3). Then, the hook 42 of the pivotal second link 28 releases the hook 30 of the pivotal trip shaft 6. Otherwise, a spring 46 biases the pivotal second link 28 toward the position shown in FIGS. 1 and 2. The hook 42 captures the pivotal trip shaft 6 in the first pivotal position (FIG. 1) before movement of the trip indicator member 8 in the first longitudinal direction 10. When the second tab 20 is engaged by the first tab 18 during movement of the trip indicator member 8 in the second longitudinal direction 12 (FIG. 5), this causes the pivotal first link assembly 26 to pivot the pivotal second link 28 (FIG. 2) and cause the hook 42 to release the pivotal trip shaft 6 from the first pivotal position (FIG. 1).

The pivotal link member 9 maintains the same position immediately before the second tab 20 is engaged by the first tab 18, when the second tab 20 is engaged by the first tab 18, and immediately after the second tab 20 is disengaged from the first tab 18 during movement of the trip indicator member 8 in the first longitudinal direction 10 (as best shown by FIG. 2 follow by FIG. 1). This follows since, during this sequence, the second tab 20 pivots in the first pivotal direction 14 (e.g., without limitation, clockwise with respect to FIG. 2). The trip indicator member 8 is released in the first longitudinal direction 10 by a spring 48, which biases the trip indicator member 8 away from a second arm 50 of the pivotal trip indicator member release 36 after a first arm 52 of the pivotal trip indicator member release 36 releases the second end 40 of the trip indicator member 8. The second arm 50 is engaged and pivoted by movement of the pivotal trip shaft 6 to the first pivotal position (FIG. 1) in which the circuit interrupter 4 is tripped and inoperable. Then, the first arm 52 responsively releases the second end 40 of the trip indicator member 8.

The pivotal trip shaft 6 is biased by a spring 54 (partially shown in FIG. 1) to the different second pivotal position (FIG. 3) in which the circuit interrupter 4 is operable. The spring 54 moves the pivotal trip shaft 6 to that different second pivotal position when the hook 42 of the pivotal second link 28 releases the hook 30 of the pivotal trip shaft 6.

FIG. 3 shows the resettable trip indicator 8 (or push button) in the reset position where the pivotal trip shaft 6 has been released by the hooks 42,30 (FIG. 1) and has rotated (counterclockwise with respect to FIGS. 1 and 3) back to its non-rotated position where it is held in that position by the pivotal trip shaft spring 54. The pivotal trip indicator member release 36 (or push button release) is rotated (clockwise with respect to FIG. 3) about pivot 56 by the spring 48 that biases the pivotal trip indicator member release 36. The first arm 52 of the pivotal trip indicator member release 36 engages the end 40 (or push button hook) of the resettable trip indicator 8. The pivotal trip indicator member release 36 holds the pivotal trip indicator member release 36 in its latched (e.g., down with respect to FIG. 3) position by the end 40 of the resettable trip indicator 8. Here, the spring-loaded pivotal trip shaft 6 is in its non-rotated, operable position, as held by the pivotal trip shaft spring 54.

Referring to FIGS. 1 and 6A, the released or popped-up position of the resettable trip indicator 8 is shown. When the circuit interrupter 4 trips because of an overload (e.g., short circuit), the pivotal trip shaft 6 is rotated (clockwise with respect to FIGS. 1 and 3) until it gets caught by the hook 42 of the pivotal second link 28 (as best shown in FIG. 1). During this rotation, an arm 58 of the pivotal trip shaft 6 engages the second arm 50 of the pivotal trip indicator member release 36 and rotates (e.g., counterclockwise with respect to FIG. 1) the pivotal trip indicator member release 36 until the first arm 52 unlatches and releases the end 40 of the resettable trip indicator 8. The resettable trip indicator 8 is then driven (e.g., upward with respect to FIG. 1) by the spring 48 to move to the popped-up position (FIGS. 1 and 6A) since the end 40 of the resettable trip indicator 8 was unlatched and released by the first arm 52.

After the pivotal trip shaft 6 is held by the trip indicator operating linkage or reset linkage chain 22 in the tripped/rotated position (FIG. 1), the resettable trip indicator 8 is driven (e.g., upward with respect to FIGS. 1 and 2) to its extended position (FIG. 6A) without disturbing the tripped/rotated position of the pivotal trip shaft 6. As the resettable trip indicator 8 is driven in this manner, the first tab 18 interferes with the second tab 20 (FIG. 2), but passes it without disturbing the rest of the first link assembly 26, the pivotal second link 28, the hooks 42,30 or the pivotal trip shaft 6, which remains in its hooked and inoperable position. In other words, the resettable trip indicator 8 does not rotate the first link assembly 26 since the second tab 20 pivots (clockwise with respect to FIGS. 1 and 2) around its own pivot 34, where it compresses the spring 35 (FIG. 2). After the first tab 18 passes the second tab 20 (as shown in FIG. 1), the second tab 20 pivots (counterclockwise with respect to FIG. 2) back around its own pivot 34 under the bias of the spring 35 until it assumes the position as shown in FIGS. 1 and 5. Here, the operating linkage or reset linkage chain 22 catches the pivotal trip shaft 6 in its tripped/rotated position, thereby making the circuit interrupter 4 inoperable.

As shown in FIGS. 1 and 2, the first link assembly 26 cannot be rotated counterclockwise (with respect to FIGS. 1 and 2) when the resettable trip indicator 8 is driven upward (with respect to FIGS. 1 and 2). Conversely, the pivotal second link 28 can rotate the first link assembly 26 clockwise (with respect to FIGS. 3 and 1) in response to the spring 46 after the pivotal trip shaft 6 moves to the tripped and inoperable position of FIG. 1. As the pivotal trip shaft 6 moves in this manner, the hook 30 no longer blocks the hook 42, and the pivotal second link 28 pivots (e.g., counterclockwise with respect to FIGS. 1 and 3) and captures the pivotal trip shaft 6 (as shown in FIG. 1).

The first tab 18, as it moves upward (with respect to FIGS. 1 and 2) passes the first link assembly 26, but without rotating it counterclockwise (with respect to FIGS. 1 and 2). This is achieved by the second tab 20, which does rotate clockwise (with respect to FIGS. 1 and 2) if pushed from the bottom up (with respect to FIGS. 1 and 2).

Conversely, when the resettable trip indicator 8 is manually driven downward (with respect to FIGS. 1 and 5) in the second longitudinal direction 12, then an edge 60 the second tab 20 engages an edge 62 of the first link assembly 26 and the entire first link assembly 26 rotates counterclockwise (with respect to FIG. 1) or clockwise (with respect to FIG. 5).

Referring to FIGS. 3 and 5, during the reset operation, when the resettable trip indicator 8 moves down (with respect to FIGS. 3 and 5) and interferes with the second tab 20, the first link assembly 26 acts as a rigid link (as is best shown in FIG. 5). In other words, the first tab 18 rotates (counterclockwise with respect to FIG. 3) the first link assembly 26 (on its way down with respect to FIGS. 3 and 5). As the first link assembly 26 pivots (counterclockwise with respect to FIG. 3), the finger 44 of the first link assembly 26 engages and rotates (clockwise with respect to FIG. 3) the pivotal second link 28. In turn, the hook 42 of the pivotal second link 28 releases and unhooks the hook 30 of the pivotal trip shaft 6. Finally, in the end of its movement (down with respect to FIGS. 3 and 5), the resettable trip indicator 8 is caught by the first arm 52 of the pivotal trip indicator member release 36.

Figure 4:
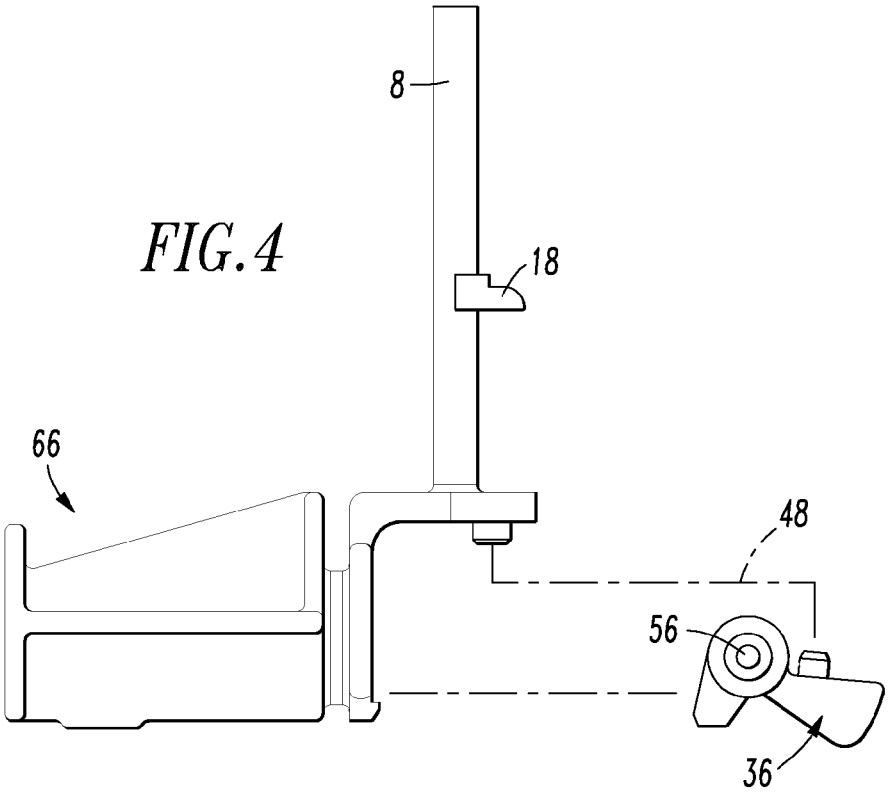
FIG. 4 is an exploded vertical elevation view of the trip indicator push button and a push button release of FIG. 1.

As shown in FIG. 4, a portion 66 of the resettable trip indicator 8 moves with it and can be employed to activate a number of micro switches (not shown).

When the resettable trip indicator 8 is pushed down (with respect to FIGS. 1, 3 and 5) to its retracted position (FIG. 6B), the operating linkage or reset linkage chain 22 (FIG. 3) releases the pivotal trip shaft 6, thereby making the circuit interrupter 4 operable again. During this reset operation, the operating linkage or reset linkage chain 22, when driven by the resettable trip indicator 8, acts as a rigid link. In contrast, the operating linkage or reset linkage chain 22 is flexible and does not respond to the resettable trip indicator 8 when the resettable trip indicator 8 moves up (with respect to FIGS. 1 and 6A) to its extended position. The changing state of the operating linkage or reset linkage chain 22 (from rigid to flexible) provides a compact, field installable, reliable solution for a trip indicator with a lockout fixture.

An important aspect of the disclosed concept is the first link assembly 26 and the two pivots 32,34 that allow the second tab 20 to act as a rigid link in one direction (counterclockwise movement of the assembly 26 with respect to FIG. 3) and as a flexible link in the opposite direction (clockwise movement of the second tab 20 with respect to FIGS. 1 and 2). Advantageously, the disclosed first link assembly 26 does not require any additional space since it does not need to be rotated in order to release the resettable trip indicator 8 to its trip indicating position (FIGS. 1 and 6A).

Referring to FIGS. 6A and 6B, the circuit interrupter 4 includes separable contacts 68 (shown tripped open in FIG. 6A and open in FIG. 6B), an operating mechanism 70 structured to open and close the separable contacts 68, a trip mechanism 72 cooperating with the operating mechanism 70 to trip open the separable contacts 68, and the resettable trip indicator mechanism 2. The trip mechanism 72 includes the pivotal trip shaft 6 pivotal between the first pivotal position (FIGS. 1 and 6A) in which the circuit interrupter 4 is tripped and inoperable and the different second pivotal position (FIGS. 3 and 6B) in which the circuit interrupter 4 is operable.

Figure 7:
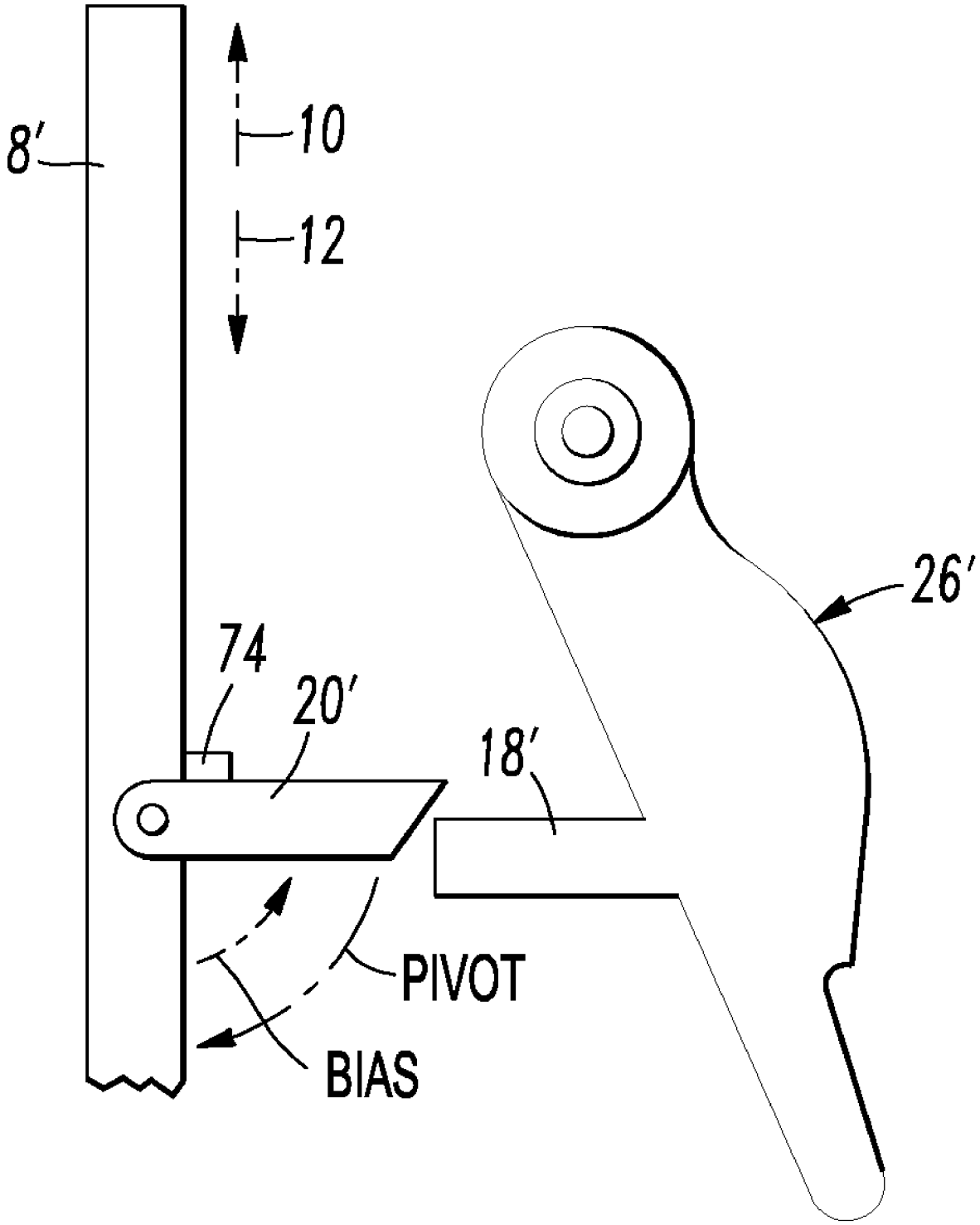
FIG. 7 is a simplified vertical elevation view of a trip indicator push button including first and second tabs in accordance with another embodiment of the invention.

Alternatively, the rigid/flexible second tab 20 can be located on the resettable trip indicator 8 as opposed to the first link assembly 26. For example, as shown in FIG. 7, a first tab 18' is fixedly coupled to a first link assembly 26'. A second tab 20' is pivotally coupled to a resettable trip indicator 8'. The second tab 20' is structured to pivot (e.g., clockwise with respect to FIG. 7) with respect to the resettable trip indicator 8' when engaged by the first tab 18' during movement of the resettable trip indicator 8' in the first longitudinal direction 10. The second tab 20' is structured to not pivot (e.g., by engaging stop 74) with respect to the resettable trip indicator 8' when engaged by the first tab 18' during movement of the resettable trip indicator 8' in the second longitudinal direction 12.

The disclosed rigid/flexible tabs 18,20 and 18',20' can be advantageously employed not only as part of the resettable trip indicator 2, but also on a wide range of circuit breaker and/or push button mechanisms. For example, it might be desired to have a push button perform several functions rather than, for example, closing (e.g., a close push button) or opening (e.g., an open push button) a circuit breaker. As another example, a momentary push button (e.g., when pressed down) can activate a linkage and when it returns back up (e.g., without limitation, springs back up to its initial position), it will not disturb a set-up which was done by pushing it down.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A mechanism for a circuit interrupter, said mechanism comprising:

a first member movable in a first longitudinal direction and a second longitudinal direction, which is opposite said first longitudinal direction;

a second member pivotal in a first pivotal direction and a second pivotal direction, which is opposite said first pivotal direction;

a first tab fixedly coupled to one of said first member and said second member; and a second tab pivotally coupled to the other of said first member and said second member, wherein said first tab is structured to engage and disengage from said second tab during movement of said first member in the first longitudinal direction, wherein said first tab is structured to engage and disengage from said second tab during movement of said first member in the second longitudinal direction, wherein said second tab is structured to pivot with respect to said other of said first member and said second member when engaged by said first tab during movement of said first member in the first longitudinal direction, and wherein said second tab is structured to not pivot with respect to said other of said first member and said second member when engaged by said first tab during movement of said first member in the second longitudinal direction.

2. The mechanism of claim 1 wherein said first tab is fixedly coupled to said first member; wherein said second tab is pivotally coupled to said second member; wherein said second tab is structured to pivot with respect to said second member when engaged by said first tab during movement of said first member in the first longitudinal direction, and wherein said second tab is structured to not pivot with respect to said second member when engaged by said first tab during movement of said first member in the second longitudinal direction.

3. The mechanism of claim 1 wherein said first tab is fixedly coupled to said second member; wherein said second tab is pivotally coupled to said first member; wherein said second tab is structured to pivot with respect to said first member when engaged by said first tab during movement of said first member in the first longitudinal direction, and wherein said second tab is structured to not pivot with respect to said first member when engaged by said first tab during movement of said first member in the second longitudinal direction.

4. The mechanism of claim 1 wherein said mechanism is a trip indicator.

5. The mechanism of claim 4 wherein said trip indicator is a resettable trip indicator; wherein said first member includes an elongated portion having a first end structured to indicate a trip condition of said circuit interrupter and an opposite second end structured to be captured during a non-trip condition of said circuit interrupter; and wherein said first tab is fixedly coupled to the elongated portion of said first member.

6. A resettable trip indicator mechanism for a circuit interrupter, said circuit interrupter including a pivotal trip shaft pivotal between a first pivotal position in which said circuit interrupter is tripped and inoperable and a different second pivotal position in which said circuit interrupter is operable, said resettable trip indicator mechanism comprising:

a trip indicator member movable in a first longitudinal direction and a second longitudinal direction, which is opposite said first longitudinal direction;

a pivotal link member;

a first tab fixedly coupled to one of said trip indicator member and said pivotal link member;

a second tab pivotally coupled to the other of said trip indicator member and said pivotal link member;

an operating linkage cooperating with said pivotal link member, said operating linkage being structured to capture said pivotal trip shaft in said first pivotal position before movement of said trip indicator member in the first longitudinal direction; and a pivotal trip indicator member release structured to capture said trip indicator member when said pivotal trip shaft is in said different second pivotal position in which said circuit interrupter is operable, and to release said trip indicator member when said pivotal trip shaft is in said first pivotal position in which said circuit interrupter is tripped and inoperable, wherein said first tab is structured to engage and disengage from said second tab during movement of said trip indicator member in the first longitudinal direction, wherein said first tab is structured to engage and disengage from said second tab during movement of said trip indicator member in the second longitudinal direction, wherein said second tab is structured to pivot with respect to said other of said trip indicator member and said pivotal link member when engaged by said first tab during movement of said trip indicator member in the first longitudinal direction, wherein said second tab is structured to not pivot with respect to said other of said trip indicator member and said pivotal link member when engaged by said first tab during movement of said trip indicator member in the second longitudinal direction, wherein one of said first tab and said second tab is structured to pivot said pivotal link member when said first tab engages said second tab during movement of said trip indicator member in the second longitudinal direction, and wherein said operating linkage is further structured to release said pivotal trip shaft from said first pivotal position responsive to said one of said first tab and said second tab pivoting said pivotal link member.

7. The resettable trip indicator mechanism of claim 6 wherein said trip indicator member includes an elongated portion having a first end structured to indicate a trip condition of said circuit interrupter and an opposite second end structured to be captured by said pivotal trip indicator member release when said pivotal trip shaft is in said first pivotal position in which said circuit interrupter is tripped and inoperable following said trip condition of said circuit interrupter; and wherein said first tab is fixedly coupled to the elongated portion of said trip indicator member.

8. The resettable trip indicator mechanism of claim 6 wherein a pivotal first link assembly includes said pivotal link member and said second tab, which is pivotally coupled to said pivotal link member; wherein said operating linkage comprises a pivotal second link having a hook; and wherein said hook is structured to capture said pivotal trip shaft in said first pivotal position before movement of said trip indicator member in the first longitudinal direction.

9. The resettable trip indicator mechanism of claim 8 wherein said pivotal first link assembly further includes a first pivot for said pivotal link member and a second pivot for said second tab; wherein said pivotal link member freely pivots about said first pivot; wherein said second tab freely pivots about said second pivot in a first pivotal direction from a normal position when said second tab is engaged by said first tab during movement of said trip indicator member in the first longitudinal direction; and wherein said second tab does not pivot about said second pivot in a second pivotal direction, which is opposite the last said first pivotal direction, when said second tab is engaged by said first tab during movement of said trip indicator member in the second longitudinal direction.

10. The resettable trip indicator mechanism of claim 6 wherein said pivotal link member maintains the same position immediately before said second tab is engaged by said first tab, when said second tab is engaged by said first tab, and immediately after said second tab is disengaged from said first tab during movement of said trip indicator member in the first longitudinal direction.

11. A circuit interrupter comprising:

separable contacts;

an operating mechanism structured to open and close said separable contacts;

a trip mechanism cooperating with said operating mechanism to trip open said separable contacts, said trip mechanism comprising a pivotal trip shaft pivotal between a first pivotal position in which said circuit interrupter is tripped and inoperable and a different second pivotal position in which said circuit interrupter is operable; and a resettable trip indicator mechanism comprising:

a trip indicator member movable in a first longitudinal direction and a second longitudinal direction, which is opposite said first longitudinal direction, a pivotal link member, a first tab fixedly coupled to one of said trip indicator member and said pivotal link member, a second tab pivotally coupled to the other of said trip indicator member and said pivotal link member, an operating linkage cooperating with said pivotal link member, said operating linkage being structured to capture said pivotal trip shaft in said first pivotal position before movement of said trip indicator member in the first longitudinal direction, and a pivotal trip indicator member release structured to capture said trip indicator member when said pivotal trip shaft is in said different second pivotal position in which said circuit interrupter is operable, and to release said trip indicator member when said pivotal trip shaft is in said first pivotal position in which said circuit interrupter is tripped and inoperable, wherein said first tab is structured to engage and disengage from said second tab during movement of said trip indicator member in the first longitudinal direction, wherein said first tab is structured to engage and disengage from said second tab during movement of said trip indicator member in the second longitudinal direction, wherein said second tab is structured to pivot with respect to said other of said trip indicator member and said pivotal link member when engaged by said first tab during movement of said trip indicator member in the first longitudinal direction, wherein said second tab is structured to not pivot with respect to said other of said trip indicator member and said pivotal link member when engaged by said first tab during movement of said trip indicator member in the second longitudinal direction, wherein one of said first tab and said second tab is structured to pivot said pivotal link member when said first tab engages said second tab during movement of said trip indicator member in the second longitudinal direction, and wherein said operating linkage is further structured to release said pivotal trip shaft from said first pivotal position responsive to said one of said first tab and said second tab pivoting said pivotal link member.

12. The circuit interrupter of claim 11 wherein said trip indicator member includes an elongated portion having a first end structured to indicate a trip condition of said circuit interrupter and an opposite second end structured to be captured by said pivotal trip indicator member release when said pivotal trip shaft is in said first pivotal position in which said circuit interrupter is tripped and inoperable following said trip condition of said circuit interrupter; wherein said pivotal trip indicator member release comprises a first arm and a second arm, the second arm being engaged and pivoted by movement of said pivotal trip shaft to said first pivotal position in which said circuit interrupter is tripped and inoperable, the first arm of said pivotal trip indicator member release responsively releasing the opposite second end of the elongated portion of said trip indicator member.

13. The circuit interrupter of claim 12 wherein a spring biases said trip indicator member away from the second arm of said pivotal trip indicator member release.

14. The circuit interrupter of claim 11 wherein said first tab is fixedly coupled to said trip indicator member; wherein a pivotal first link assembly includes said pivotal link member, said second tab, which is pivotally coupled to said pivotal link member, a first pivot for said pivotal link member and a second pivot for said second tab; wherein said operating linkage comprises a pivotal second link having a hook; wherein said hook captures said pivotal trip shaft in said first pivotal position before movement of said trip indicator member in the first longitudinal direction; wherein said pivotal link member freely pivots about said first pivot;

wherein said second tab freely pivots about said second pivot in a first pivotal direction from a normal position when said second tab is engaged by said first tab during movement of said trip indicator member in the first longitudinal direction;

wherein said second tab does not pivot about said second pivot in a second pivotal direction, which is opposite the last said first pivotal direction, when said second tab is engaged by said first tab during movement of said trip indicator member in the second longitudinal direction, thereby causing said pivotal first link assembly to pivot said pivotal second link and cause said hook to release said pivotal trip shaft from said first pivotal position.

15. The circuit interrupter of claim 14 wherein said pivotal first link assembly further comprises a finger, which engages and pivots said pivotal second link; wherein said pivotal trip shaft comprises a hook; and wherein the hook of said pivotal second link releases the hook of said pivotal trip shaft.

16. The circuit interrupter of claim 15 wherein said pivotal trip shaft is biased by a spring to said different second pivotal position in which said circuit interrupter is operable; and wherein said spring moves said pivotal trip shaft to said different second pivotal position when the hook of said pivotal second link releases the hook of said pivotal trip shaft.

17. The circuit interrupter of claim 11 wherein said pivotal first link assembly further includes a first pivot for said pivotal link member and a second pivot for said second tab; wherein said pivotal link member freely pivots about said first pivot; wherein said second tab freely pivots about said second pivot in a first pivotal direction from a normal position when said second tab is engaged by said first tab during movement of said trip indicator member in the second longitudinal direction; wherein said pivotal link member does not pivot when said second tab is engaged by said first tab during movement of said trip indicator member in the second longitudinal direction; wherein said second tab compresses a spring when it freely pivots about said second pivot in the first pivotal direction from the normal position when said second tab is engaged by said first tab during movement of said trip indicator member in the first longitudinal direction; and after said second tab is disengaged from said first tab during movement of said trip indicator member in the first longitudinal direction, said spring pivots said second tab back to said normal position in an opposite second pivot direction.

* * * * *